US008382023B2

(12) United States Patent
Barea

(10) Patent No.: US 8,382,023 B2
(45) Date of Patent: Feb. 26, 2013

(54) DEVICE AND METHOD FOR THE CONSTANT TENSION FEEDING OF THREADS OR YARNS FED IN A DISCONTINUOUS WAY

(75) Inventor: Tiziano Barea, Busto Arsizio (IT)

(73) Assignee: B.T.S.R. International S.p.A., Busto Arsizio (VA) (IT)

( * ) Notice: Subject to any disclaimer, the term of this patent is extended or adjusted under 35 U.S.C. 154(b) by 285 days.

(21) Appl. No.: 12/921,834

(22) PCT Filed: Mar. 9, 2009

(86) PCT No.: PCT/EP2009/001663

§ 371 (c)(1),
(2), (4) Date: Sep. 10, 2010

(87) PCT Pub. No.: WO2009/112221

PCT Pub. Date: Sep. 17, 2009

(65) Prior Publication Data

US 2011/0006096 A1 Jan. 13, 2011

(30) Foreign Application Priority Data

Mar. 11, 2008 (IT) ..... MI2008A0410

(51) Int. Cl.
*B65H 51/30* (2006.01)
*B65H 59/36* (2006.01)

(52) U.S. Cl. ..... 242/365.7; 242/417.3; 242/154

(58) Field of Classification Search ..... 242/365.7, 242/416, 417, 417.3, 420.5, 153, 154; 66/125 R, 66/132 R, 146

See application file for complete search history.

(56) References Cited

U.S. PATENT DOCUMENTS

| | | | | |
|---|---|---|---|---|
| 328,540 | A * | 10/1885 | Tibbles | 242/154 |
| 2,423,630 | A * | 7/1947 | Wainwright | 66/146 |
| 3,962,891 | A * | 6/1976 | Rouzaud | 66/132 R |
| 4,669,677 | A | 6/1987 | Roser et al. | |
| 4,752,044 | A | 6/1988 | Memminger et al. | |
| 2005/0173579 | A1 | 8/2005 | Barea | |
| 2007/0227197 | A1 | 10/2007 | Corsani | |

FOREIGN PATENT DOCUMENTS

| | | | |
|---|---|---|---|
| WO | 03085183 | A1 | 10/2003 |
| WO | 2005111287 | A1 | 11/2005 |

* cited by examiner

*Primary Examiner* — William E Dondero
(74) *Attorney, Agent, or Firm* — Novak Druce Connolly Bove + Quigg LLP

(57) ABSTRACT

Device and method for constant tension feeding, threads or yarns fed to textile or winding machine or metallic wire to similar machine, in discontinuously with phase sequences. The thread motion has at least first and second feeding or absorption states following each other in time. A controller, connected to a tension detector and thread accumulator, intervenes on the accumulator based upon tension value from the detector. A compensator, between the accumulator and tension detector, cooperates with thread to compensate variation of feeding or absorption state of the thread upon passage between each first and second feeding or absorption state. The controller intervenes to modify the accumulator's action on thread and maintain tension value detected by the detector at set value. Interaction between thread and compensator keeping constant tension value during the changing phase of the feeding state. The compensator freely moveable under action of thread relative to a resting position.

20 Claims, 5 Drawing Sheets

DEVICE AND METHOD FOR THE CONSTANT TENSION FEEDING OF THREADS OR YARNS FED IN A DISCONTINUOUS WAY

CROSS-REFERENCE TO RELATED APPLICATION

This application is a §371 National Stage Application of International Application No. PCT/EP2009/001663, filed on Mar. 9, 2009, which claims the benefit of Italian patent application no. MI2008A000410, filed Mar. 11, 2008.

The object of the present invention is a device for the constant tension feeding of threads or yarns fed discontinuously to a machine, such as a textile machine, a winding machine (or coil winder) or other similar machine working on metallic wires, according to the preamble of the main claim. A method apt to implement the above-mentioned method is also an object of the invention.

Devices for feeding yarns of the type able to feed constant tension threads or yarns are known. Said devices work according to a known closed-loop control methodology obtained with a known constant tension thread feeder. The method guarantees the regular feeding of a thread or yarn independently from the feeding speed of said thread and also independently from the tension variation of the thread entering said constant tension thread feeder; all this both if the tension variation is due to the gradual emptying of the yarn packages or the bobbins of metallic wire, and if such variations are due to tears or extra-tensions due to the irregular unwinding of such threads or yarns.

A known constant tension thread feeder used in the textile field (for example object of EP 1492911 in the name of the same Applicant) comprises a tension sensor, an actuator or motor acting onto a feeding wheel or pulley and a control (electronic) unit usually comprising a processor or "DSP" (Digital Signal Processor) able to analyze the thread tension value measured by the above-mentioned sensor by comparing a wished working tension value (or SET POINT) and based upon the detected tension value. The control unit intervenes onto the motor so as to work on the pulley connected thereto by braking or feeding the thread in order to control and keep constant the tension of the thread itself fed to a textile machine (for the production of a manufactured product or for processing the thread itself).

From U.S. Pat. No. 4,752,044 an apparatus for controlling in an electronic way the tension of a thread is known wherein a rotating member is provided whereupon the thread winds for a certain number of turns and a tension detector defined by a mobile arm, acting as thread-guiding member, apt to allow detecting the thread tension through the motion thereof. In the invention according to the prior art, the mobile arm is still subjected to a position control and to the action of an electric motor apt to control the motion of such arm in order to keep the wished tension.

In the prior art, then, the presence of the motor limits the reactivity of the arm which cannot move freely in guiding the thread. The thread and the members connected thereto have an inertia so as to influence the free thread feed causing defects in the manufactured product or even the yarn break.

An analogous solution is described in U.S. Pat. No. 4,669,677.

Such devices (and the methodologies implemented thereby) have performance limits in case the thread is fed to the textile machine with discontinuity that is in case the thread motion takes place with at least a first and at least a second feeding or absorption state by the textile machine different therebetween. Such different feeding states follow each other in time. The above-mentioned limits are linked to the response speed of the actuator (electric motor) or of the pulley to the "stress" of the control unit to intervene after the changed thread feeding state (for example alternating high absorption states with other very low absorption states); said absorption discontinuity is known in the knitting industry as jacquard processing. It has been noted, in particular, that also by using actuators or motors with more and more high performances, however it is not possible obtaining a performance level able to satisfy any application.

Due to this, in many case yarn storage feeders are used which limit to accumulate a certain number of thread turns onto a drum therefrom the yarn is subsequently freely unwound also in case of yarn pick-up with high absorption discontinuity. Such solution, however, has the limit of using a much more bulky device than the device mentioned previously and wherein the tension is not controlled or is not controlled in an optimum and precise way; when such unwinding tension is subjected to control, it is however controlled in a limited way and inside a determined tension interval according to a manual adjustment made onto the device.

Furthermore, the known devices working on threads fed in a discontinuous way have additional limits when the thread is of "rigid", that is not elastic, type (under this term meaning the fact that the thread for example has an elongation value lower than 10%, considering that some elastomers easily reach an elongation of 300%), as it is the case of the metallic wires. In this case, in fact, not being able to exploit the intrinsic elasticity of the thread itself to compensate the delay of the response thereof to adapt to the changed state of the thread itself, such known devices cannot be used with said rigid threads.

The object of the present invention is to offer a method for controlling the feeding of a thread or a yarn fed in a discontinuous way to a machine such as a textile machine or a winding machine or similar machine working on a metallic wire and a device for the implementation thereof which are improved with respect to the corresponding already known methods and devices.

In particular, an object of the invention is to offer such device which can overcome the limits of a known constant tension thread feeding device of the type with pulley mentioned above in feeding a thread fed in a discontinuous way to a machine, for example a textile machine, as it happens in case of jacquard processings or selection of meshes in a knitting machine.

Another object of the present invention is to allow the use of a device for feeding constant tension thread also in case the thread is picked-up in a discontinuous way, which allows a much higher programming precision and flexibility and use than a known yarn Storage Feeder.

An additional object of the invention is to offer a device having the high dynamic acceleration/deceleration performances of a known constant tension feeding device, but which substantially overcomes any application limit of the latter in feeding (textile or metallic) threads or yarns fed in a discontinuous way.

Still another object of the invention is to offer a device which can be used with extremely rigid threads and yarns (with elasticity proximate to 0%, however lower than 10%) which further limit the application of the classical devices for feeding constant tension thread or yarn.

An additional object is to offer a device and a method allowing to obtain, in advance, information substantially predicting and indicating the fact that a sudden thread or yarn absorption increase or decrease is taking place, thus allowing an action and an anticipated reaction of the control system which could intervene in controlling the constant tension feeding device.

Still another object is to offer an invention allowing to obtain a control and a still more precise quality of the thread or yarn feeding and with still higher repeatability results with respect to the equivalent known solutions.

An additional object of the invention is to provide a device of the mentioned type able to feed, with the same performance and quality features, both an elastic thread and a rigid thread, the object of the present invention being practically able to consider elastic even rigid threads.

An additional object is to offer a device and method apt to control a machine, a textile machine or a machine for processing metallic wires, by stopping it in case a thread irrecoverable control failure has occurred, for example if the feeding device has been erroneously set and the yarn feeding quality thereof can be in some way jeopardized.

These and other objects which will result to be evident to the person skilled in the art are reached by a device and a method according to the enclosed claims.

For a better comprehension of the present invention the following drawings are enclosed by simple way of example, but not for limitative purpose, wherein.

Figure 1:
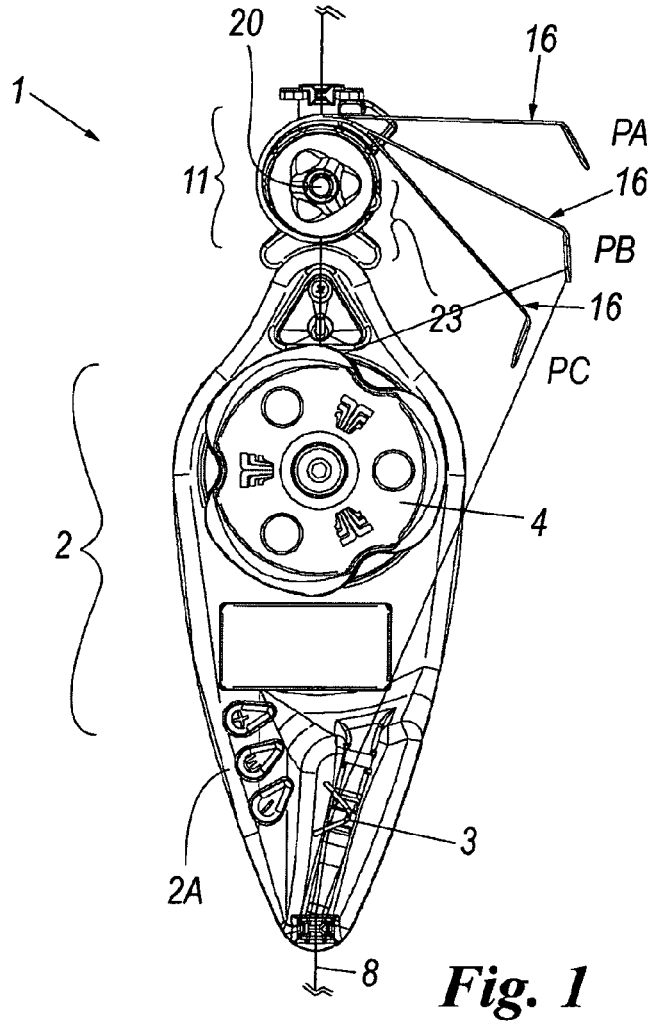
FIG. 1 shows a front view of a device according to the invention associated to a known device for controlling the tension of a thread fed to a textile machine.

By referring to the mentioned figures (wherein corresponding portions have identical reference numerals) and in particular to FIG. 1, a device according to the invention is generally designated with 1 and it comprises a first portion or feeder (hereinafter called the "actuator") 2 (defined by a known constant tension feeder) having a tension sensor 3, a pulley 4 (or equivalent accumulation organ) moved by its own electric motor and a preferably microprocessor control unit, usually comprising a processor or "DSP" ("Processore digitale di segnale") ("Digital Signal Processor") able to analyze the tension value of a thread 8 detected by the sensor 3, to compare it to a prefixed value (or SET POINT) and to control and adjust the thread tension (if different from the wished value) by means of the action onto the above-mentioned electric motor and therefore onto the pulley 4. Such actuator 2 and the portions thereof 3, 4 (the motor and the control unit are not shown) are of type and operation known on themselves and therefore they will not be further described. It allows to feed the thread 8 to a textile machine with constant tension. It is to be noted that the textile machine can be productive unit of manufactured products or a machine for processing the yarn.

The device 1, according to the invention, comprises a second portion or compensator 11 apt to cooperate with the thread 8 after it has passed onto the pulley 4. Such compensator, then, results to be inside the thread tension adjusting ring, as it can be seen in FIG. 4. Thanks to the invention solution, the dynamic performances of the device 1 can be increased, since the latter will be able to meet instantaneously the sudden thread absorption (positive and negative) variations, by "band-aiding" the time necessary to the motor to reach the new speed without causing positive or negative tension peaks onto the yarn final tension.

Furthermore, the presence of the compensator 11 inside the adjustment ring always guarantees that the tension of the thread outgoing from the feeder 2 is always the set one.

Figure 5:
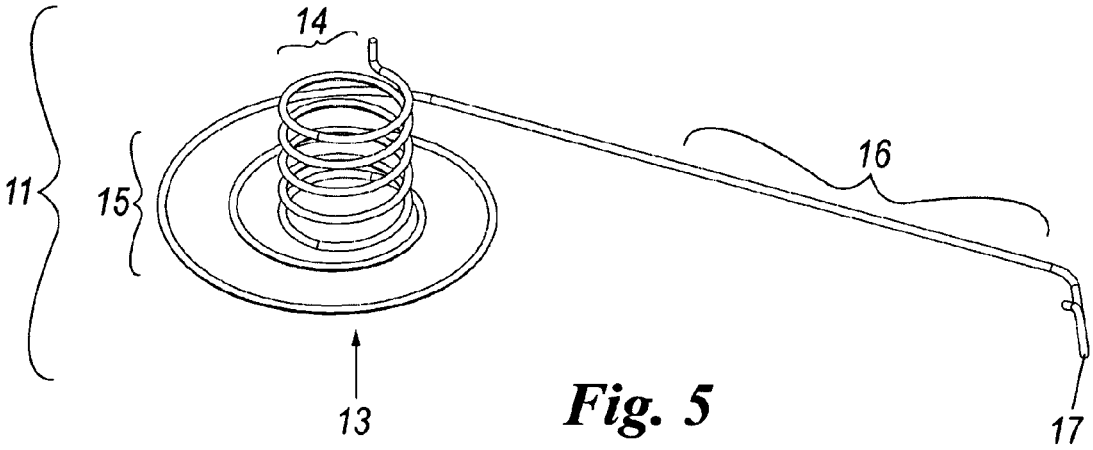
FIG. 5 shows a portion of the device according to the invention in another embodiment thereof.

More in particular, the compensator 11, in the simpler version (FIG. 5) comprises a compensating spring 13 having a first cylindrical portion 14, a second spiral-like portion 15 and an end arm 16 having an extreme and ending half-ring or hook 17 apt to receive slidingly the thread 8. The spring 13 is coupled to the actuator 2 (or other fixed portion proximate to a textile machine if the spring 13 is not associated directly to the actuator 2) through the cylindrical portion thereof 14 fitted onto a suitable (not shown) pin of the body 2A of the actuator 2 supporting also the pulley 4 and the other components of said actuator.

Figure 2:
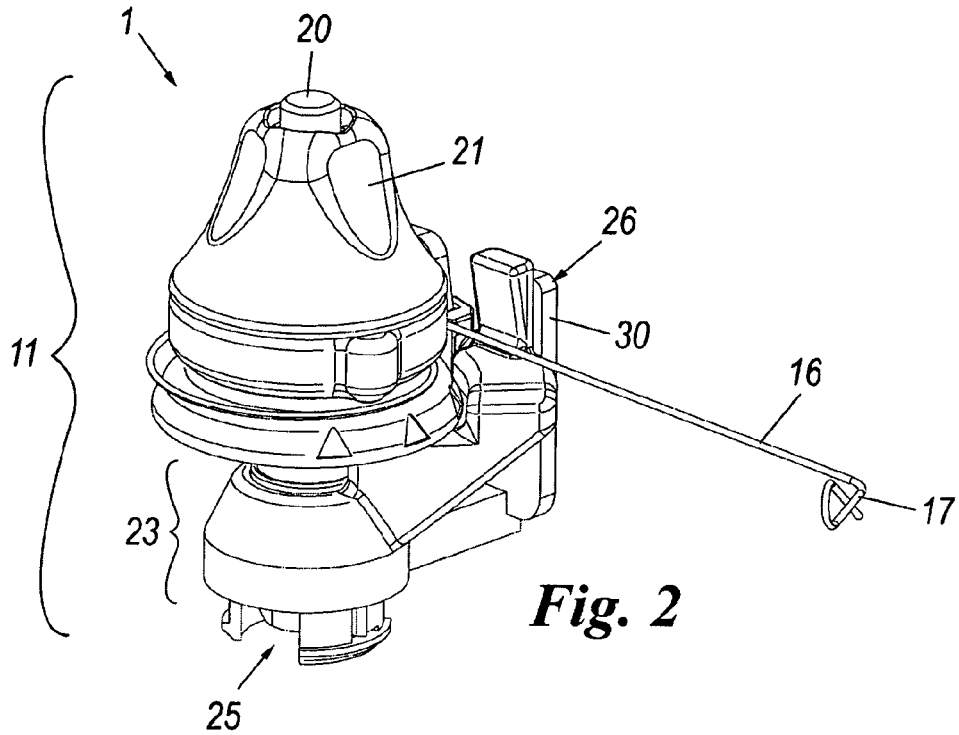
FIG. 2 shows a perspective view of a portion of the device according to the invention in a first embodiment thereof shown in FIG. 1.

FIG. 2, instead, shows another embodiment of the compensator 11 according thereto the spring 13 is associated to an anchoring pin 20 by means of a knob 21 apt to adjust manually the elastic behaviour of the spring under the action of the thread 8. The knob and the pin are then associated to a body 23 which can be coupled to the actuator 2 by means of a fixing member 25, the latter being associated to a thread guide 26, for example made of ceramic material.

The spring 13 of the compensator 11 could assume several working positions as it can be seen in FIG. 1: in a phase of feeding the thread 8 with constant absorption by the textile machine, the spring is in a position PB which is intermediate or however inside a possible motion path (comprised between opposed limited positions PC and PA) of the arm 16 (see FIG. 1); after a sudden absorption increase, the arm 16 could move from the position "PB" to a position "PC" by eliminating or reducing drastically the peak of tension outgoing from the device 1 and in the meantime allowing the motor acting onto the pulley 4 to reach the new speed, which will make the spring to return from the position "PC" to the position "PB". The spring passage from the position "PB" to the position "PA" corresponds analogously to an absorption decrease, with subsequent return to the position PB when the motor will have brought the pulley 4 to rotate at a speed so as to keep however always constant the tension of the thread 8 fed to the textile machine with the always constant set tension thereof.

In other words, each modification of the thread feeding state corresponds to a variation in the absorption of the same and a corresponding variation of the position of the spring 13 of the compensator 11 with respect to the body 2A of the actuator 2; such position variation allows the control unit of the pulley 4 to intervene onto the motor controlling the latter so as to bring it into the rotation or stationary state so as to correspond to the thread varied motion state.

Figure 3A:
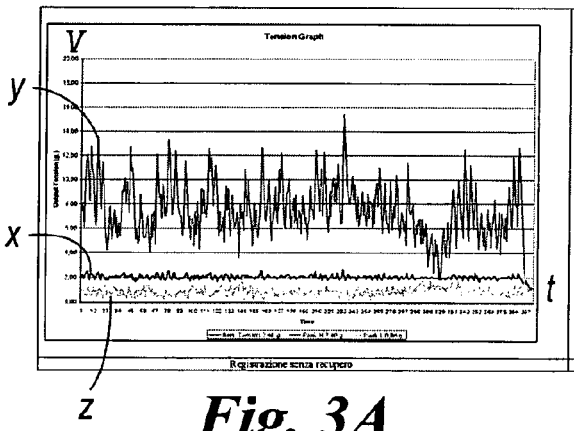
FIGS. 3A and 3B show two graphs illustrating the tension course in time in a thread fed with a device known on itself of the type with constant tension feeding and the course of the same tension in time in a thread fed with a device according to the invention.
Figure 3B:
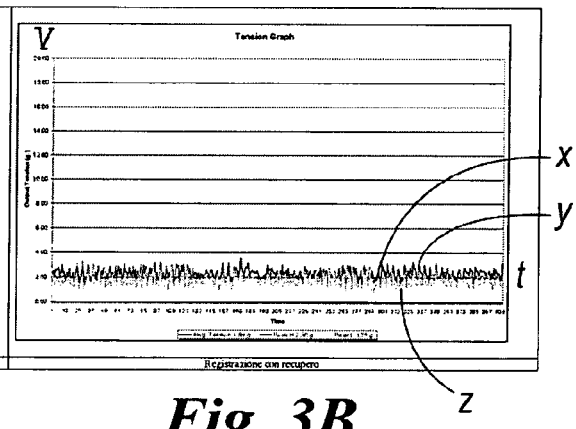

FIGS. 3A and 3B shows two recordings of the tension course in case of a device for feeding the thread with standard constant tension and a device according to the invention equipped with compensator 11 in a jacquard application. As it results clear from the recordings, upon analyzing the signal course it results clear that both the average tension course (trace X) and the both positive (trace C) and negative (trace Z) tension peak course is clearly more regular in the second case (compensator presence). In particular, a drastic reduction in the tension peaks can be noted, this reduction allows not to stress the thread, to reduce the breaking risk due to extra-tension in case of delicate threads and consequently to be able to increase the speed of the textile machine, thus obtaining a remarkably higher productivity, quality and efficiency.

It results evident that the system reactivity and therefore the capability of compensating more or less high absorption discontinuities correspond to the spring force and that the possibility of compensating both positive and negative absorption variations correspond to the spring capability of remaining in position "PB" during the constant absorption phases. It is then clear that the system dynamics is strictly connected to the reactivity and thus to the mass or lightness of the used spring. Therefore, springs made of titanium or other ultra-light material such as aluminium, magnesium or alloys thereof or composite, for example carbon fibres or other, could be used. By way of example, the titanium specific gravity is 4.87 kg/dm$^3$, lower than the steel one (7.8 kg/dm$^3$). Such use raises the system dynamic performances to levels so as to practically guarantee any absorption variation during the thread feeding. It results then evident that an interaction between the control unit of the pulley 4 and the compensator allows to raise drastically the performances of the end device.

Thus, advantageously, it is preferable mounting inside the compensator 11 a linear Hall sensor 30 and magnetizing the spring; in this way, the control unit can know the position of the spring 13 during the operating phases and use this piece of information to control the motor acting onto the pulley 4. Upon a sudden increase in the thread consumption by the textile machine, in fact, a spring motion from the position "PB" to the position "PC" follows, which motion, properly measured and controlled by the control unit, allows for example to increase in advance the rotation speed of the pulley in order to reach quickly the new feeding speed and consequently bring the spring back to the initial position "PB".

Once known then the position of the compensator 11, the control unit is able to make that, after a motion thereof to compensate a (positive or negative) consumption variation, the spring 13 always returns to the initial central position thereof, so as to be immediately ready to compensate a new (positive or negative) absorption variation.

By further monitoring the position variations of the compensating spring 13 it is also possible checking that such position does not ever exceed fixed limits (extra-strokes) in order to avoid that the compensator 11 may be in a place wherein it has no more room for performing the compensation in one of the two directions and in case signalling an alarm and stopping the machine.

Since the capability of compensating more or less high absorption discontinuities depends, as said, upon the force of the spring itself, an additional interaction between the control unit and the compensator 11 is that allowing the control unit to vary the force of the spring itself for example by means of driving, by the above-mentioned control unit, an associated electric motor working on the knob 21. This in order to optimize the control thereof depending upon the application or the operating conditions. In fact, by monitoring the position variations of the compensating spring 13 it may happens that such position does not ever exceed fixed limits (extra-strokes) in order to avoid that such compensator may be in a position wherein it has no more room for compensating in one of the two directions and acting consequently onto the force of the spring itself.

Figure 4:
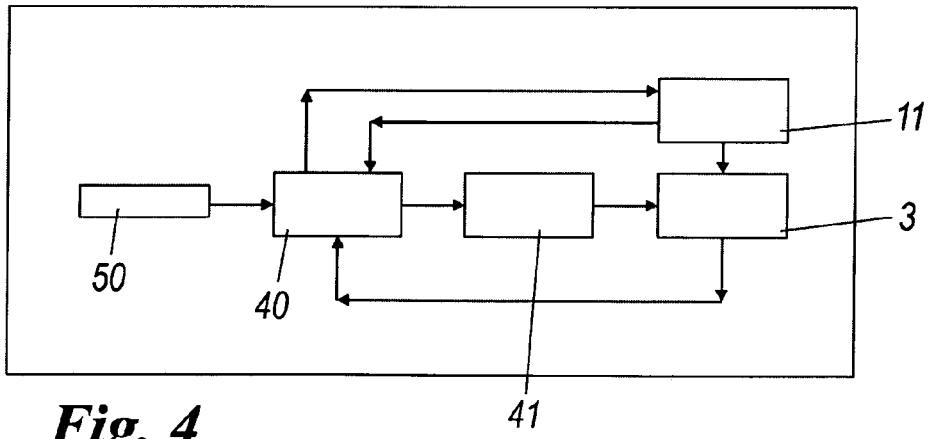
FIG. 4 shows a block diagramme of a device according to the invention.

FIG. 4 shows a block diagramme related to the operation of the invention device based upon what previously described. Such figure shows the control unit or PID 40, the actuator 41 of the pulley 4 (the electric motor), the tension sensor 3 and the compensator 11. The unit 40 works according to the modes mentioned above based upon a prefixed tension value or set point 50.

Thanks to the invention several advantages are obtained, which could be well understood from the preceding description. Furthermore, the use of the mobile arm 16 downwards the pulley or accumulation organ 4 allows using and controlling a "rigid" thread as if it were elastic since the motion of the arm 16 compensates the thread rigidity in case of variations of the feeding state of the thread itself. The obtained elasticity level will be then finely adjusted depending upon the spring force, adjusted manually or automatically.

Figure 6:
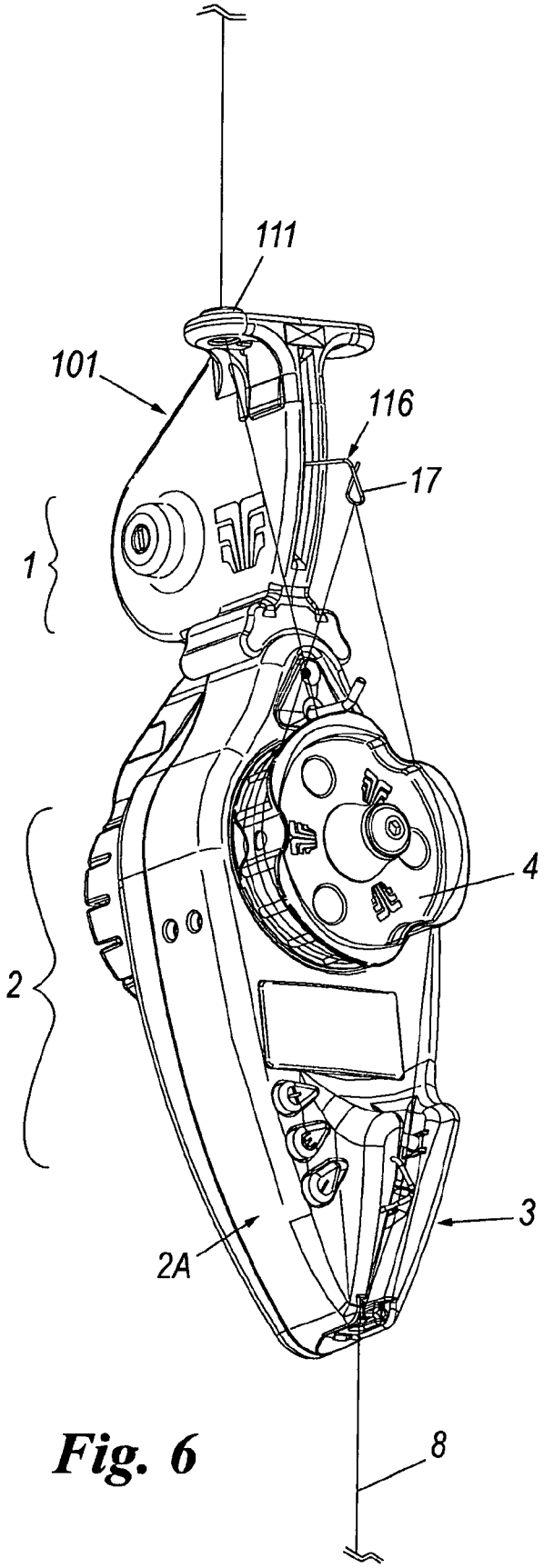
FIGS. 6 and 7 show perspective views from different angulations, of a variant of the invention associated to a device like that of FIG. 1.
Figure 7:
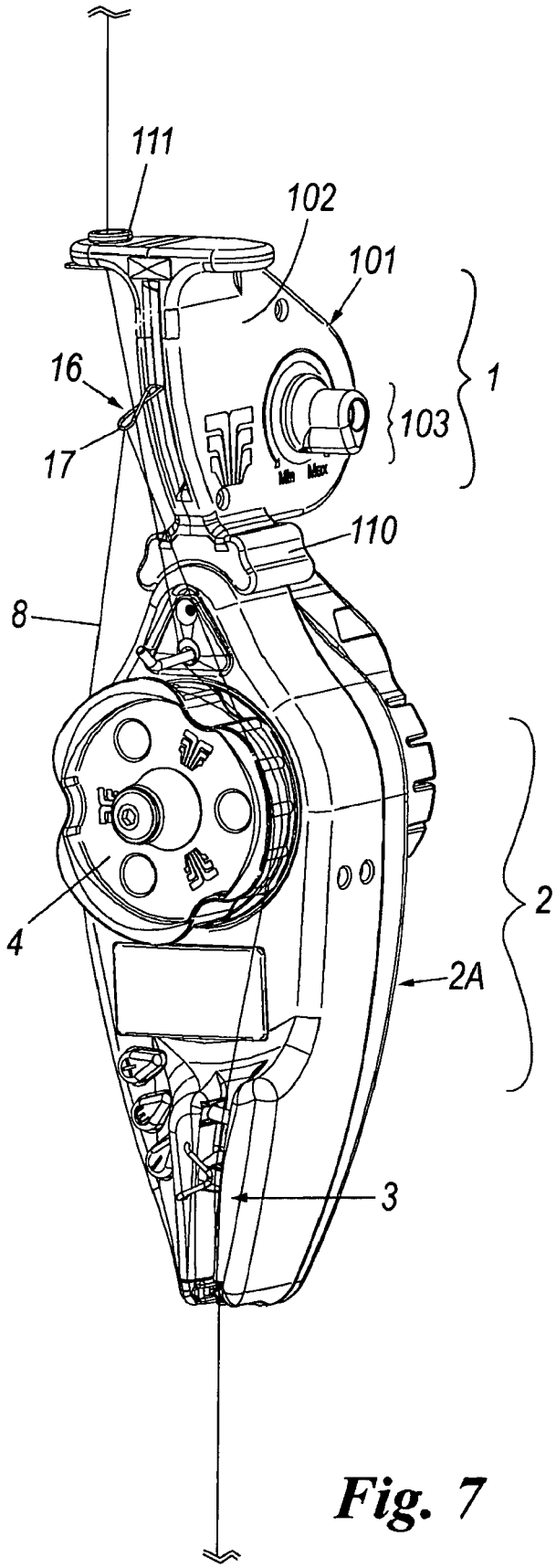
Figure 8:
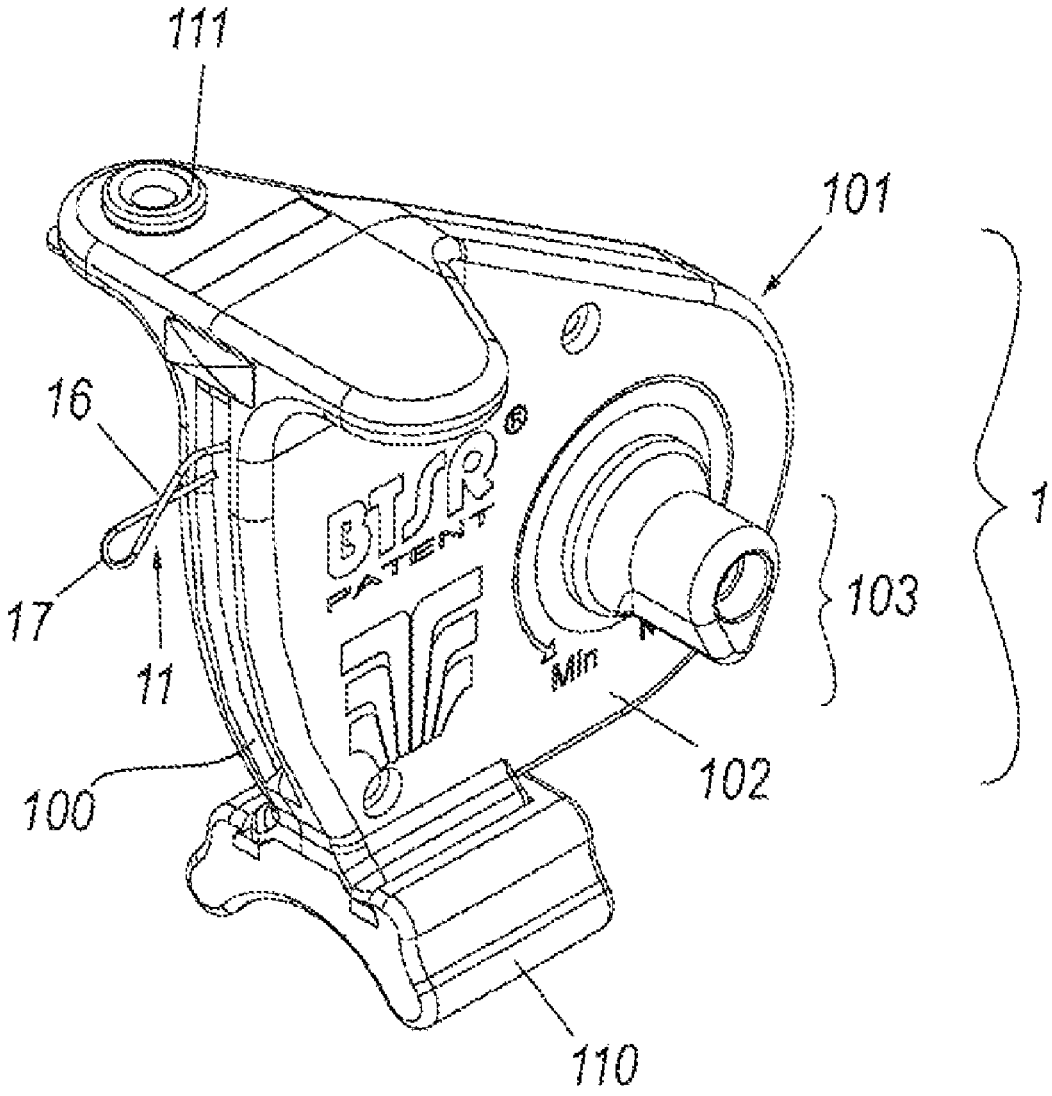
FIG. 8 shows a perspective view of the invention variant according to FIG. 6.

In particular, in FIGS. 6-8 the device according to the invention has the arm 16 outgoing from a slot 100 of a body 101 of the device 1. On a flank 102 of such body there is an organ or knob 103 apt to adjust the response of the arm (elastic arm 16, however free to move in the slot under the action of the thread 8) analogous to the knob 21 of FIG. 2. Furthermore, the body 101 has an ending portion 110 apt to couple with the body 2A of the device 2 and a thread guide 111.

As it can be noted in the figures under examination, the thread 8 detaches from the pulley 4 tangentially thereto, it reaches the arm 16 and returns onto the pulley in a way still tangential thereto. This allows to keep a precise triangulation for the tension measurement which is performed downwards the pulley; furthermore, it allows a greater stabilization of the thread cooperating with the arm 16.

Various embodiments of the invention have been described; still other embodiments are possible and are to be meant within the scope of the following claims. In particular, even if the preceding description makes reference to the textile field, the invention has to be considered also extended to the field of the machines winding metallic wires or similar machines; for example, the invention can be used onto a machine winding a metallic wire which unwounds from a bobbin and which is used to implement windings for electric motors or the like. Therefore, any reference in the present text to a thread must be meant as referring both to a textile thread and to a metallic wire.

The invention claimed is:

1. A device for the constant tension feeding of elongate feed selected from the group consisting of threads, yarns and metallic wires, said threads or yarns fed to a textile machine or a winding machine or said metallic wire fed to a similar machine for working on the metallic wire, said machine to produce a manufactured product or to process the respective thread or yarn or wire, comprising:

tension detecting means, thread or yarn or wire, respectively, accumulating means, control means connected to said detecting means and said accumulating means, said accumulating means and said control means connected to said detecting means and said accumulating means are provided to intervene on the accumulating means based upon a tension value of the elongate feed obtained from said detecting means, as said feeding taking place in a discontinuous way that is with phase sequences wherein the thread or yarn or wire motion takes place with at least a first and at least a second feeding or absorption state by the machine different therebetween, said states following each other in time, a separate compensating means arranged between said accumulating means and said tension detecting means to cooperate with such thread or yarn or wire to compensate a variation of the feeding or absorption state of the thread or yarn or wire upon the passage between each first and each second feeding or absorption state following the first one, this allowing the control means to intervene onto the accumulating means to modify the action thereof onto the thread or yarn or wire and to keep constant in time the tension value detected by the detecting means at a set value, said constant tension value being kept also during the changing phase of the feeding state thanks to the interaction between said thread or yarn or wire and said compensating means, the compensating means being able to move freely under the action of the thread or yarn or wire with respect to a resting position.

2. The device according to claim 1, wherein said compensating means comprises a mobile compensating organ to compensate with the motion thereof the thread or yarn or wire absorption variation in the transient state between two different feeding states, said compensating organ moving from the resting position in the feeding direction of the thread or yarn or wire when the thread or yarn or wire passes from a state of less absorption by the machine to a state of greater absorption, but moving in the opposite direction when the thread or yarn or wire passes from a state of greater absorption to a state of less absorption, said motion being obtained in an automatic and free way and by allowing the control means to adapt the action of the accumulating means onto the thread or yarn or wire to the changed feeding state so as to keep constant the tension thereof, said compensating organ returning back to the resting position at the end of said critical absorption variation.

3. The device according to claim 2, wherein the resting position is inside a motion path of the compensating organ having two limit positions.

4. The device according to claim 2, wherein the compensating organ is an elastically deformable member comprising an elongated arm to cooperate with the thread or yarn or wire by an at least hook end thereof, said arm overhanging from at least a portion of said elastically deformable member therethrough the elastically deformable member is placed in fixed position near the machine.

5. The device according to claim 4, wherein the elastically deformable member is a spring, the arm overhanging from a spiral portion associated to a cylindrical portion constraining the spring to a fixed support near the machine.

6. The device according to claim 5, wherein such spring is made of ultra-light material.

7. The device according to claim 5, wherein such spring is made of ultra-light material selected from the group consisting of titanium, magnesium, aluminium, alloys thereof or composite material.

8. The device according to claim 4, wherein the elastically deformable member is associated to a support which can be positioned in fixed position near the machine, with said deformable member cooperating with adjusting means of the elastic response of such elastically deformable member associated to such support.

9. The device according to claim 8, comprising actuating means to modify the action of the adjusting means onto the elastically deformable member, said actuating means controlled by the control means.

10. The device according to claim 4, comprising sensor means to detect the motion of the elongated arm of the elastically deformable member with respect to the resting position (PB).

11. The device according to claim 10, wherein said sensor means is connected to a control unit of the thread or yarn or wire constant tension feeding to the machine defining the control means of such feeding, said unit cooperating and controlling said accumulating means to keep constant the thread or yarn or wire tension during the thread or yarn or wire feeding to said machine based upon the data detected by said sensor means and therefore based upon the position assumed by the elongated arm with respect to the resting position.

12. The device according to claim 4, wherein the elastically deformable member is associated to a support which can be positioned in fixed position near the machine, with said deformable member cooperating with adjusting means of the elastic response of such elastically deformable member associated to such support, the elastically deformable member comprising a thread or yarn or wire guiding member therewith the thread or yarn or wire cooperates before contacting the elongated arm of such deformable member.

13. The device according to claim 4, comprising sensor means to detect the motion of the elongated arm of the elastically deformable member with respect to the resting position and the extent of such motion with respect to such position.

14. The device according to claim 2, wherein the mobile compensating organ is placed, with respect to the accumulating means so the thread or yarn or wire detaches tangentially from the accumulating means to reach said compensating organ and that such thread or yarn or wire always returns tangentially onto said accumulating means by detaching from said compensating organ, this allowing the thread or yarn or wire to assume a triangular figure.

15. The device according to claim 1, wherein the compensating means is separate from the tension detecting means, thread or yarn or wire accumulating means and the control means.

16. The device according to claim 1, wherein the compensating means is placed in an upper portion of the device and the tension detecting means is placed in a lower portion of the device.

17. A method for controlling the constant tension feeding of elongate feed selected from the group consisting of threads, yarns and metallic wires, said threads or yarns fed to a textile machine or a winding machine or said metallic wires fed to a similar machine to work on the metallic wires, said machine to produce a manufactured product or to process the respective thread or yarn or wire, comprising:

said feeding taking place in discontinuous way that is with phase sequences wherein the respective thread or yarn or wire motion takes place with at least a first state and at least a second feeding or absorption state by the machine different therebetween, such states following each other in time, detecting the tension of the thread or yarn or wire and the possible adjustment thereof by means of the cooperation thereof with accumulating means to keep said tension at a constant and pre-fixed value, characterized in that downstream the cooperation with the accumulating means shifting the thread or yarn or wire from a position thereof of normal feeding corresponding to a first feeding state when the passage to the second feeding or absorption takes place, said shifting taking place by moving a mobile organ or compensator placed onto such path and therewith said thread or yarn or wire cooperates downstream the accumulating means in a direction towards the machine or in the opposite one depending upon the fact if an increase or a decrease in the thread or yarn or wire absorption takes place, said mobile organ or compensator bringing the thread or yarn or wire back into the normal working position at the end of the state change or critical event.

18. The method according to claim 17, comprising detecting the motion of the mobile organ or compensator and the shifting level of the same from a resting position thereof corresponding to the position of normal thread or yarn or wire feeding, said detection allowing to intervene onto the accumulating means to modify the action thereof onto the thread or yarn or wire and to keep constant in time the value of the tension thereof even in case of critical event or variation of the thread or yarn or wire absorption state.

19. The method according to claim 17, comprising adjusting the motion level of the mobile organ or compensator to adjust the position of the thread or yarn or wire normal feeding independently from the working tension thereof.

20. The method according to claim 19, wherein said adjustment takes place by intervening onto a mobile actuator cooperating with said compensating organ.

* * * * *